United States Patent [19]

Hayashi et al.

[11] 4,359,178

[45] Nov. 16, 1982

[54] WEB INFEED TENSION CONTROL SYSTEM WITH DANCER ROLL

[75] Inventors: Hiromi Hayashi, Tokyo; Shigeru Takahashi, Machida; Kazuo Kawamura, Hachioji, all of Japan

[73] Assignees: Komori Printing Machinery Company, Ltd.; Nihon Regulator Co., Ltd., both of Tokyo, Japan

[21] Appl. No.: 161,780

[22] Filed: Jun. 23, 1980

[30] Foreign Application Priority Data

Jun. 3, 1978 [JP] Japan ..... 53-75153

[51] Int. Cl.[3] ..... B65H 23/18

[52] U.S. Cl. ..... 226/25; 226/44

[58] Field of Search ..... 226/25, 24, 29, 30, 226/31, 40, 42, 44, 195

[56] References Cited

U.S. PATENT DOCUMENTS

| | | | |
|---|---|---|---|
| 3,087,663 | 4/1963 | Anderson | 226/44 |
| 3,322,315 | 5/1967 | Eberlin | 226/44 |
| 3,539,085 | 11/1970 | Anderson et al. | 226/25 |
| 3,556,369 | 1/1971 | Ferguson | 226/25 |
| 3,680,753 | 8/1972 | Shaw-Stewart | 226/25 |
| 3,724,733 | 4/1973 | Schaffer et al. | 226/25 |
| 3,974,948 | 8/1976 | Kroppenstedt | 226/44 X |

*Primary Examiner*—Stanley N. Gilreath
*Attorney, Agent, or Firm*—Charles E. Pfund

[57] ABSTRACT

An improved web infeed system feeds a web of material to printing plate roll having a tension sensor, a compact differential drive unit and a dancer roll mechanism. A main rotation input is imparted from a drive motor to the flexible spline while a portion of main rotation input is imparted via a clutch to the wave generator in the direction opposite to the rotation of the flexible spline, and the result of computing said two rotation inputs is obtained from the circular spline to produce an output, then the state of engagement between the clutch and output is changed by a controller which computes the signal of a tension sensor in a place advance circuit, thereby controlling the rotation speed of said output to maintain constant the tension of the web. Dancer roll mechanism is interposed between the infeed roll and a pinch roll mounting the tension sensor thereon and is so adjusted as to be in an equilibrium of force to the tension of the web of material by air cylinder or air spring via a lever arm for eliminating any minute tension variation. A control valve applies a control pressure, in response to a change in the preset tension, to the air cylinder or air spring for enabling the dancer roll to continue the action at a fixed position. In the case of needing a sudden decrease of the web tension, a solenoid valve interposed between the air cylinder or air spring and the control valve is energized to evacuate the air cylinder or air spring to break said equilibrium of force.

7 Claims, 10 Drawing Figures

WEB INFEED TENSION CONTROL SYSTEM WITH DANCER ROLL

BACKGROUND OF THE INVENTION

The present invention relates to generally a web infeed tension control system for use in a printing press, more particularly to an improved web infeed tension control apparatus including a compact differential unit cooperated with a tension sensor and a dancer roll mechanism.

DESCRIPTION OF THE PRIOR ART

In the conventional printing presses known heretofore, a chain type continuous speed changing mechanism has been employed for the purpose of maintaining a constant tension in a web being advanced toward a printing press, wherein each tension is kept at a fixed value by an operator who watches occurrence of a tension variation and changes the speed reduction ratio correctly in accordance therewith as shown in FIG. 1. In an offset rotary press, a printing plate roll is driven by means of a main drive motor to execute printing on a web, and the rotation of an infeed roll is changed properly by the chain type continuous speed changer to keep the tension of the web constant.

And another conventional printing press known heretofore includes and apparatus equipped with a differential gearing, a clutch and a brake means, as shown in FIG. 2, wherein the differential gearing serves to drive an infeed roll. The output of a main drive motor is applied directly to a main input shaft of the differential gearing, and the same output is also applied indirectly to a fine-adjustment input shaft via a clutch, whose output is coupled to the input of the brake. A tension signal detected by a tension sensor is computed in a controller, and a transmission torque of the clutch is adjusted in accordance with the result thereof to maintain the tension of the web constant. In this apparatus, the differential gearing consists of bevel or spur planetary gears.

Several of these web infeed system are shown in U.S. Pat. Nos. 3,680,753, 3,539,085, 3,322,315 and 3,087,663.

However, these systems have some disadvantages in the following points. In the first type employing a chain type continuous speed changing mechanism, it is impossible to maintain a fixed speed reduction ratio even though a reduction handle of the speed changer is held stationary. That is, if there occurs any variation in the tension of the web portion on a paper feed roll, the tension of the entire web is varied directly cause defective printing as a result of positional deviation. In addition to such a disadvantage, tremendous labor is required for adjustment of the tension, and a great loss is unavoidable due to resultant faulty products.

In the second type equipped with a differential gearing, a clutch and a brake, it is unavoidable that the gearing becomes dimensionally bulky for attaining a sufficient torque required in a printing press, and naturally both a module and a pitch circle are rendered large. A greater module brings about enlargement of a play between the gears to increase a backlash thereof, hence disturbing a control system to cause harmful influence on the printing position. Moreover, in order to release the clutch, there comes out the necessity of providing a brake and further a power source for the brake. Thus, it follows that the apparatus should be equipped with a differential gearing, a clutch, a brake and a power source therefore, thereby needing a surplus space and making the cost extremely high.

SUMMARY OF THE INVENTION

The present invention has been accomplished in an attempt to eliminate the above-described disadvantages existing in the prior art.

Accordingly, it is an object of the present invention to provide an improved web infeed tension control system to maintain a constant tension in a web being advanced toward a printing plate roll.

It is another object of the present invention to provide an improved web infeed tension control apparatus without any braking means.

It is the principal object of the present invention to provide an improved web infeed tension control apparatus to remove a minute tension variation regarded as an impediment to printing.

It is still more specific object of the present invention to provide an improved web infeed tension control apparatus to minimize the backlash.

It is among the objects of the subject invention to provide an improved web infeed tension control apparatus ensuring quick correction of any tension variation.

It is still another object to provide an improved web infeed tension control apparatus breaking the equilibrium of force to the tension of the web of material in the case of needing a sudden decrease of the web infeed tension.

A further object of the present invention is the provision of a dancer roll mechanism enables previous removal of minute tension variation to enhance the advantageous effect of the phase advance circuit.

A still further object of the present invention is the provision of a dancer roll mechanism having an advantage that there is no necessity of changing the original pressure of the chamber regardless of a change in the preset tension.

An even further object of the present invention is the provision of the control apparatus constructed in remarkably small dimensions and at a low cost.

The above and further objects and novel features of the invention will more fully appear from the following detailed description when the same is read in connection with the accompanying drawings. It is to be expressly understood, however, that the drawing is for purpose of illustration only and is not intended as a definition of the limits of the invention.

DETAILED DESCRIPTION OF THE PREFERRED EMBODIMENTS

Hereinafter the basic operating principle of the invention will be described in detail with reference to the accompanying drawings.

The present invention provides a web feed mechanism which readily operates to maintain a constant tension in the web. The web feed mechanism of the present invention includes a harmonic drive differential unit comprising a flexible spline, a wave generator and a circular spline, wherein a main rotation input is imparted to the flexible spline while a minute rotation input is imparted via a clutch to the wave generator in the direction opposite to the rotation of the flexible spline, and the result of computing such two rotation inputs is obtained from the circular spline to produce an output. Then the state of engagement between this output and the clutch is changed by a controller which computes the tension signal of a tension sensor in a phase advance circuit, thereby controlling the output rotation to maintain constant the tension of a web. Moreover, a dancer roll mechanism comprising a dancer roll, an air cylinder, a solenoid valve and a control valve is interposed between the infeed roll and a pinch roll mounting the tension sensor thereon, and the dancer roll is so adjusted as to be in an equilibrium of force to the web tension by the air cylinder or an air spring, wherein the control valve is attached to the air cylinder so as to continue the operation at a fixed position automatically in response to a change in the tension preset by the controller, thereby eliminating any minute tension variation, and in the case of needing a sudden decrease of the web tension, the air cylinder or air spring is evacuated by the action of the solenoid valve.

Figure 1:
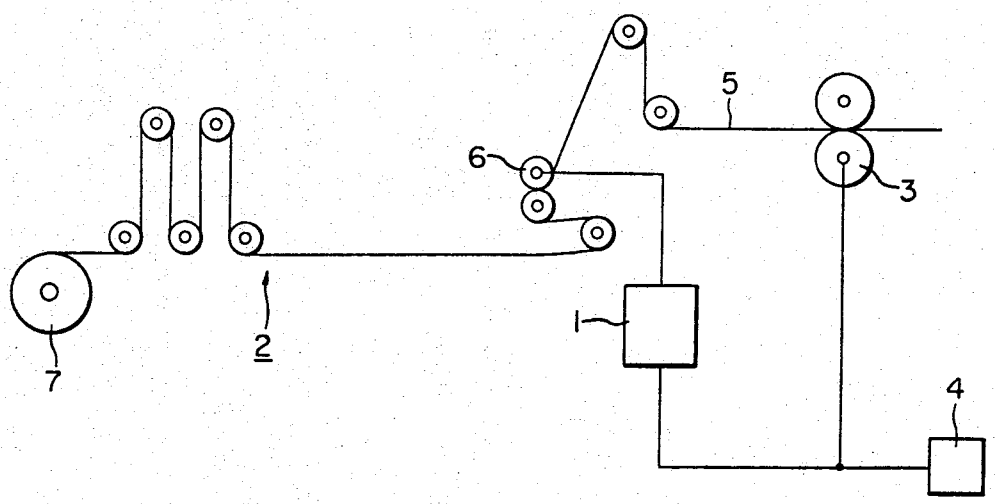
FIG.1 (PRIOR ART)
FIG. 1 and FIG. 2 show block diagrams of conventional web infeed tension control systems.
Figure 2:
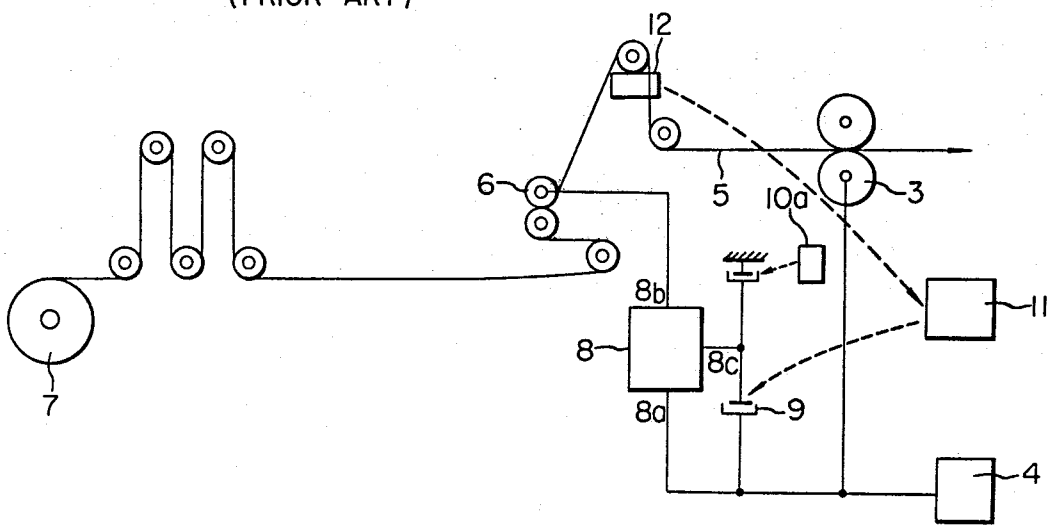
FIG.2 (PRIOR ART)
Figure 3:
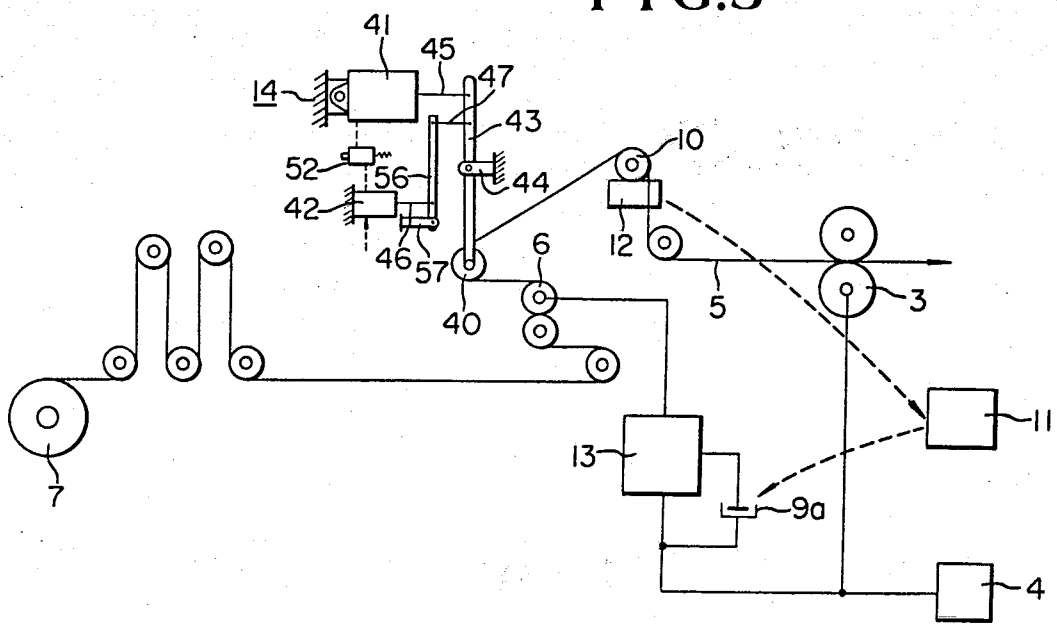
FIG. 3 is a block diagram of a web infeed tension control system according to the present invention.

Referring first to FIG. 3, the web infeed tension control apparatus according to the invention includes a paper feed roll (7), an infeed roll (6), a printing plate roll (3), a web (5), a main drive motor (4), a controller (11), a clutch (9*a*), a harmonic drive differential unit (13) and a dancer roll mechanism (14).

Figure 4:
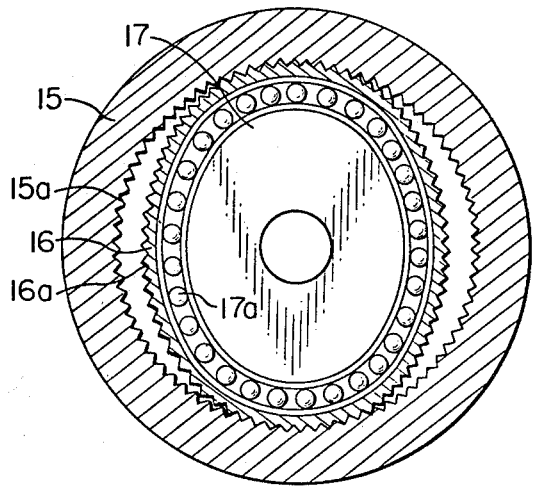
FIG. 4 is a sectional view of a differential driving unit employed in the present invention.
Figure 5:
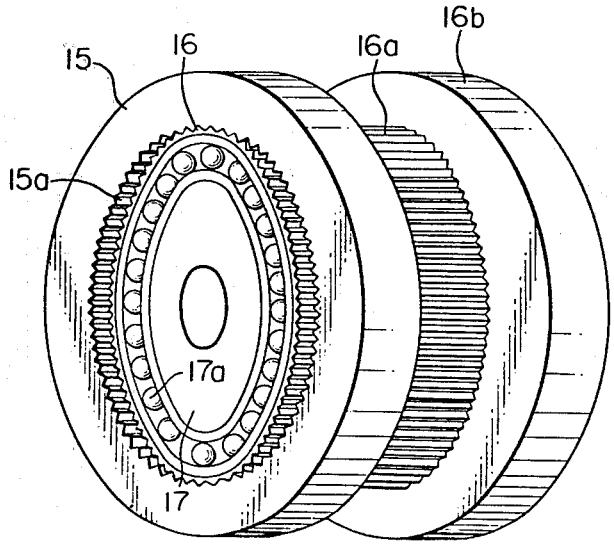
FIG. 5 is a schematic perspective view of the differential driving unit shown in FIG. 4.

The harmonic drive differential unit (13) illustrated in FIGS. 4 and 5, and principal components thereof include a circular spline (15), a flexible spline (16) and a wave generator (17). The circular spline (15) is composed of a rigid ring whose inner circumference has teeth 15*a* slightly more in number than those of the flexible spline (16). The wave generator (17) is shaped into an ellipse so as to deform the flexible spline (16) elliptically and to rotate the same forcedly through rotation thereof. A bearing (17*a*) is provided on the outer circumference of the wave generator (17) to ensure smooth elliptical motion. Due to the flexibility of the spline (16), it is shaped to be elliptical forcedly by the wave generator (17) and is engaged in its apsidal direction with the circular spline (15). The teeth (16*a*) of the flexible spline (16) are slightly less in number than those of the circular spline (16*b*). Another circular spline (15) has rigidity and forms, on its inner circumference, teeth equal in number to those of the flexible spline (16) so as to rotate therewith in the same manner. To facilitate understanding, it is supposed here that the circular spline (15) is fixed. That is, with the flexible spline (16) fixed, the wave generator (17) is rotated clockwise. Zc denotes the number of teeth of the circular spline (15), and Zf denotes that of the flexible spline (16). These two splines are engaged with each other along the apsidal line of the ellipse, and the circular spline (15) is rotated clockwise at a rate of (Zc−Zf) per rotation of the wave generator (17), causing a speed reduction of (Zc−Zf)/Zc in the same rotational direction. Subsequently, the flexible spline (16) is rotated counterclockwise at a speed of Nf (r.p.m.), while the wave generator (17) is rotated clockwise at a speed of Nw (r.p.m.). Then the circular spline (15) is rotated counterclockwise at a speed expressed by the following equation.

$$Nf \times (Zf/Zc) - Nw \times [(Zc - Zf)/Zf]$$

Based on the above principle, the operation of this invention is performed as follows.

Figure 6:
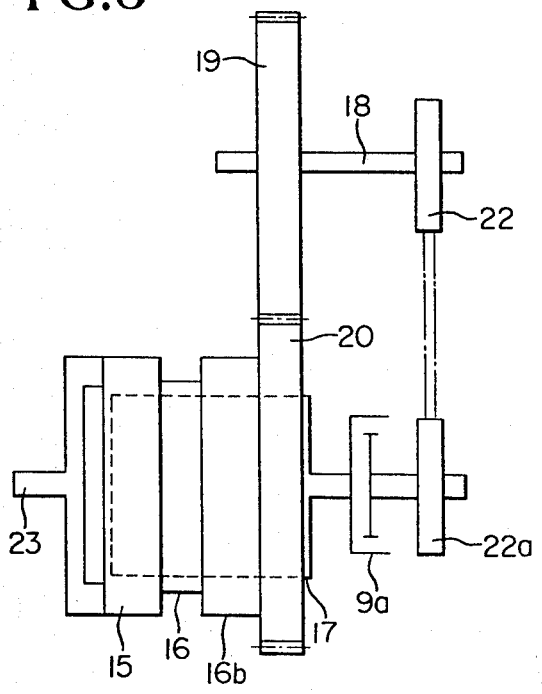
FIG. 6 is a schematic diagram illustrating how a clutch is coupled to the differential driving unit of the present invention.

Referring to FIG. 6, rotation from the main drive motor (4) is imparted to an input shaft (18) and is further transmitted to a gear (20) via a gear (19), so that the rotation input is eventually imparted to the circular spline (15) secured to the gear (20). The rotational direction is reversed against the input shaft by means of the gears (19) and (20), and the main rotation of an output shaft (23) is obtained in this direction. The rotation of the input shaft is further transmitted to a clutch (9*a*) via pulleys (22), (22*a*) and a timing belt. When the clutch (9*a*) is engaged at its on-position, its output rotation is transmitted to the wave generator (17). In this case, the rotational direction is the same as that of the input shaft, and the rotation is imparted through speed reduction to the circular spline (15).

Consequently, the output shaft (23) coupled to the circular spline (15) is driven in the reverse rotational direction against the input shaft in accordance with the aforementioned equation. The point of importance here resides in that the engagement between the circular spline (15) and the flexible spline (16) for receiving the most part of the transmitted torque is effected by a plurality of teeth to bring about a remarkable increase of the intensity as a result. Therefore, extremely small module teeth are sufficient to meet the requirement, hence minimizing the backlash. Another merit is that the rotational direction of the flexible spline (16) and the wave generator (17) are rendered opposite to each other. In this case, according to the rotation of the flexible spline (16), the wave generator (17) is driven by an elliptical member in the same direction. Thus, in order to stop or reverse the rotation of the wave generator (17), it becomes necessary to apply thereto a torque equivalent to the elasticity that forms the ellipse. That is, when the wave generator (17) is in the reverse rotation against the flexible spline (16), it means that a reverse torque or a braking force is applied to the wave generator (17). As described above, the backlash is so small in this differential unit, and no brake mechanism is required at all.

Figure 7:
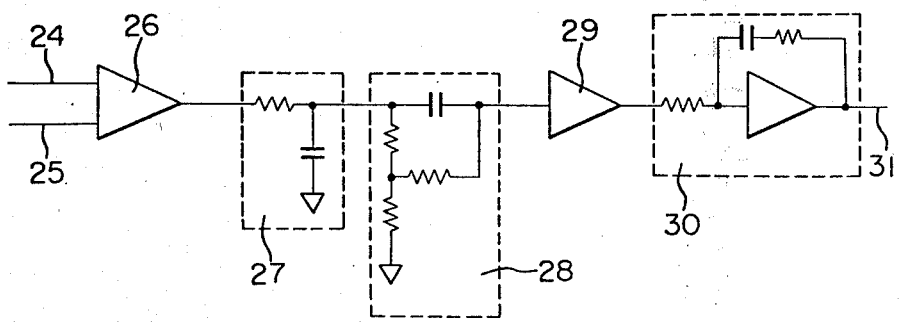
FIG. 7 is a circuit diagram of a controller employed in the invention.

FIG. 7 is a diagram of an electric circuit in a control system of the apparatus shown in FIG. 3. Summarizing the operation, the tension of the web of material (5) is detected as it passes over a pinch roll 10 on its way to the printing plate roll 3 in the form of an analog value by the tension sensor (12) and then is fed to the controller (11) so as to be computed, and the state of coupling between the clutch (9*a*) and the differential unit (13) is changed in accordance with the result of computation, thereby changing the rotation speed of the infeed roll (6) to adjust the tension of the web of material (5). If the computation in the controller (11) is executed in a proportional control mode, there occurs a delay to bring about failure in following up a sudden tension variation. The circuit of FIG. 7 is implemented by eliminating such a disadvantage. In this circuit, a detected value (24) is compared with a target (preset) tension value (25) by a deviation computing unit (26). With respect to the output of this unit, a noise component resulting from the unbalance of the sensing roll or a variation component of any frequency higher than 5 Hz is decreased by a phase delay circuit (27), and further a tension variation component of any frequency lower than 5 Hz is computed by a phase advance circuit (28). Thus, the tension variation is detected by the circuit (28), and a correction signal is fed to the clutch (9*a*) to form a non-delay closed loop.

However, there also occurs in some printing presses a small-amplitude variation component of irregular frequencies (hereinafter referred to as varied-frequency component). And the phase advance circuit (28) performs its correcting action in response to the varied-frequency component as well and thereby causes a hunting phenomenon.

A dancer roll mechanism (14) to be described below serves to eliminate such varied-frequency component.

Figure 8:
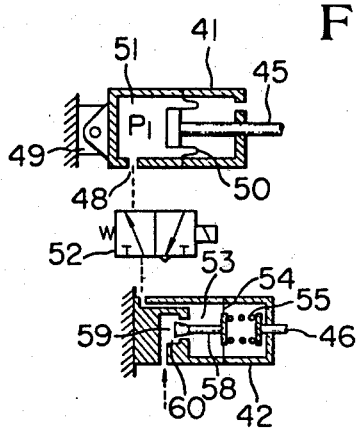
FIG. 8 shows the structure of an air cylinder, a control valve and a solenoid valve in the present invention.

As illustrated in FIGS. 3 and 8, the dancer roll mechanism (14) consists of a dancer roll (40), an air cylinder (41) and a control valve (42) which are coupled with one another by means of an arm (43).

The arm (43) is supported at its middle point by a pivot (44) with its one end connected to the center shaft of the dancer roll (40), and the other end thereof is connected to a piston rod (45) of the air cylinder (41) and also to a rod (47) which is finally connected to a transmission rod (46) of the control valve (42). The air cylinder (41) is anchored at its bottom to the chassis of the control apparatus by a support (49) in the manner to be slightly pivotable. The inside of the air cylinder (41) is divided into two chambers by a partition wall (50), to which one end of the piston rod (45) is secured. An opening (48) is formed in an output chamber (51) located on the reverse side of the rod (45) and communicates with a control chamber (53) for a control valve (42) via a solenoid valve (52).

The control valve (42) is anchored to the apparatus chassis and is divided into two chambers by a partition wall (54) as in the air cylinder (41), and a spring (55) is secured to one surface of the partition wall (54) on the reverse side of the chamber (53). The spring (55) is coupled to the arm (43) via a transmission rod (46), an arm (56) and a rod (47). A rod (57) is connected to the end of the arm (56) to form a fulcrum, and another rod (58) extends from the partition wall (54) into the chamber (53) to constitute a valve (60) for an original pressure chamber (59). The pressure in this chamber is connected to a suitable pressurizing device so that the internal pressure is adjustable as desired.

In the action of the dancer roll mechanism (14), the force of the air cylinder and the web tension applied to the dancer roll (40) are so adjusted as to be set fundamentally in a state of equilibrium at the two ends of the arm (43). Among effective area A1 ($cm^2$) of the partition wall (50), output pressure P1 ($kg/cm^2$) of the output chamber (51), tension (resultant force) T (kg) of the web (5), and arm ratio K of the arm (43): a relation of $T \cdot K = A1 \cdot Pl$ is established as $T \times K$ (kg) is transmitted to the piston rod (45), thereby attaining an equilibrium of force. If the tension preset by the controller (11) is changed with Pl remaining fixed, the tension T of the web (5) is varied to change the center position (preset position) of the dancer roll (40), so that the equilibrium is lost.

Accordingly, in response to a tension variation from T to Tx, the control valve (42) functions to keep the equilibrium by changing the output pressure from Pl to Px.

Among effective area A2 ($cm^2$) of the partition wall (54) in the control valve (42), control pressure Px ($kg/cm^2$) of the control chamber (53), flexure $\delta$(cm) of the spring (55) connected to the transmission rod (46), and spring constant k (kg/cm): there is a relation expressed as $$Px = (\delta \cdot k)/A2$$

The transmission rod (46) is actuated by the return arm (56) to open or close the valve (50), thereby sending a control pressure Px, which is proportional to $\delta \cdot k$, from the original pressure chamber (59) to the output chamber (51) of the air cylinder (41) to maintain the equilibrium of force.

The dancer roll mechanism (14) equipped with the air cylinder (41) and the control valve (42) has an advantage that there is no necessity of changing the original pressure Po of the chamber (59) regardless of a change in the preset tension, so that the operation can be performed at a fixed position automatically. And furthermore, the aforementioned varied-frequency component can be absorbed due to the compressibility of air and the flexibility of the partition wall (50).

Figure 9:
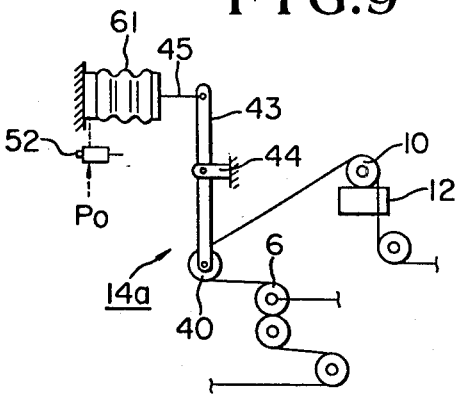
FIG. 9 is a block diagram of an example using an air spring instead of an air cylinder.
Figure 10:
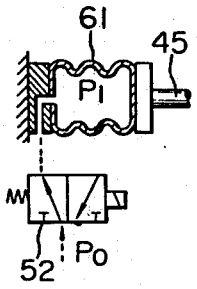
FIG. 10 shows the structure of an air spring and a solenoid valve.

FIGS. 9 and 10 show another dancer roll mechanism (14*a*) of different type, wherein an air spring (61) is employed instead of the air cylinder (41), with the control valve omitted. This type is adapted for use in a printing system in which a preset tension need not be changed, wherein an operator adjusts an original pressure Po as desired through a solenoid valve (52) to attain an equilibrium. The air spring (61) is shaped into bellows composed of synthetic rubber, and is commercially available for cushion or antivibration use. Similarly to the aforementioned air cylinder (41), this air spring is capable of absorbing any minute tension variation which is unremovable in the conventional tension control apparatus without a dancer roll mechanism (14) or (14*a*).

When a sudden stop is executed during a fixed-speed operation in a printing process or when an operator conducts maintenance or check during a low-speed operation, there comes out the necessity of decreasing the web tension. In such a case, reduction of the web tension can be accomplished rapidly by first switching an air passage in the solenoid valve (52) in response to a signal from a control panel and then exhausting the output pressure Pl to the atmosphere to break the equilibrium. The solenoid valve suited for this purpose is two-position three-way type. In the present invention, the tension detected by the tension sensor (12) is displayed to be visually inspectable so that the operator can monitor the tension with facility.

The effects achievable by the infeed tension control apparatus of the above-described structure are listed below.

(1) The backlash is minimized by the use of a compact differential unit.

(2) The control apparatus can be constructed in remarkably small dimensions and at a low cost due to the non-necessity of a brake mechanism.

(3) Employing a phase advance circuit ensures quick correction of any tension variation.

(4) Additional provision of a dancer roll mechanism enables previous removal of minute tension variation to enhance the advantageous effect of the phase advance circuit.

What is claimed is:

1. A web infeed tension control system in a printing press for feeding a web of material from a paper feed roll to a printing plate roll driven at a predetermined speed by a drive motor, said system comprising; a web infeed roll, a differential drive unit drivingly connected with said web infeed roll, said differential drive unit including a circular spline, a flexible spline, and a wave generator with an output shaft thereof coupled to said web infeed roll; wherein a rotation input is imparted from said drive motor to said flexible spline while a portion of said input is imparted to said wave generator in the direction opposite to rotation of said flexible spline, and the result of computing said two rotation inputs is obtained from said circular spline to produce an output; said system further including a clutch means changing state of coupling between said differential drive unit and said drive motor in accordance with the result of computation; dancer roll mechanism interposed between said web infeed roll and a pinch roll, said dancer roll mechanism including a dancer roll pressed against said web material with a constant pressure, an air cylinder, a solenoid valve, a control valve and a lever arm coupling said dancer roll, air cylinder, solenoid valve and control valve; wherein said dancer roll is so adjusted as to be in an equilibrium of force to the tension of said web material by said air cylinder via said lever arm, and said control valve applies, in response to changes in the preset tension, a control pressure to said air cylinder for enabling the dancer roll to continue the action at a fixed position; a web tension sensor means positioned between said pinch roll and the printing plate roll for sensing tension changes in said web material; and control means computing signals of said web tension sensor means in a phase advance circuit and controlling the rotation speed of said wave generator via said clutch means.

2. A web infeed tension control system in a printing press for feeding a web of material from a paper feed roll to a printing plate roll driven at a predetermined speed by a drive motor, said system comprising; a web infeed roll, a differential drive unit drivingly connected with said web infeed roll, said differential drive unit including a circular spline, a flexible spline, and a wave generator with an output shaft thereof coupled to said web infeed roll; wherein a rotation input is imparted from said drive motor to said flexible spline while a portion of said input is imparted to said wave generator in the direction opposite to rotation of said flexible spline, and the result of computing two said rotation inputs is obtained from said circular spline to produce an output; said system further including a clutch means changing state of coupling between said differential drive unit and said drive motor in accordance with the result of computation; dancer roll mechanism interposed between said web infeed roll and a pinch roll, said dancer roll mechanism including a dancer roll pressed against said web material with a constant pressure, a lever arm, pivot means pivotally supporting the lever arm midway between its ends, means rotatably mounting the dancer roll to the lever arm at one side of its pivot, an air cylinder, means pivotally supporting the air cylinder at one end for pivotal movement, a piston in the air cylinder, a rod connecting the piston to the lever arm at the other side of its pivot, a control valve, a valve part in the control valve movable therein to open and close the control valve, transmission means connecting the valve part to the lever at said other side of its pivot and a solenoid valve connecting said air valve and control valve so as to provide communication therebetween, wherein said dancer roll is so adjusted as to be in an equilibrium of force to the tension of said web material by said air cylinder via said lever arm, and said control valve applies, in response to changes in the preset tension, a control pressure to said air cylinder for enabling the dancer roll to continue the action at a fixed position; a web tension sensor means positioned between said pinch roll and the printing plate roll for sensing tension changes in said web material; and control means computing signals of said web tension sensor means in a phase advance circuit and controlling the rotation speed of said wave generator via said clutch means.

3. A web infeed tension control system according to claim 1 wherein a flexible partition divides the air cylinder into two chambers, a piston is connected to one side of the flexible partition within one of the chambers and the solenoid valve provides communication between the other chamber of the air cylinder and the control valve.

4. A web infeed tension control system according to claim 3 wherein a flexible partition divides the control valve into two chambers, one of which is connected by way of the solenoid valve to said other chamber of the air valve movable therein to open and close the control valve, a spring in the other chamber of the control valve connected at one end to the flexible partition and transmission means connecting the other end of the spring to the lever arm.

5. A web infeed tension control system in a printing press for feeding a web of material from a paper feed roll to a printing plate roll driven at a predetermined speed by a drive motor, said system comprising; a web infeed roll, a differential drive unit drivingly connected with said web infeed roll, said differential drive unit including a circular spline, a flexible spline, and a wave generator with an output shaft thereof coupled to said web infeed roll; wherein a rotation input is imparted from said drive motor to said flexible spline while a portion of said input is imparted to said wave generator in the direction opposite to rotation of said flexible spline, and the result of computing said two rotation inputs is obtained from said circular spline to produce an output; said system further including a clutch means changing state of coupling between said wave generator and said drive motor in accordance with the result of computation; dancer roll mechanical interposed between said web infeed roll and a pinch roll, said dancer roll mechanism including a dancer roll pressed against said web material with a constant pressure, a cantilever-supported air spring, a solenoid valve and a lever arm coupling said dancer roll and air spring; wherein said dancer roll is so adjsuted as to be in equilibrium of force to the tension of said web material by said air spring via said lever arm to continue the action of said dancer roll at a fixed position; a web tension sensor means for sensing tension changes in said web material as it travels from the pinch roll to the printing plate roll, and control means computing signals of said web tension sensor means in a phase advance circuit and controlling the rotation speed of said wave generator via said clutch means.

6. A web infeed tension control system according to claim 5 wherein the air spring is in the form of a flexible bellows supported at one end.

7. A web infeed tension control system according to claim 6 wherein the bellows is comprised of synthetic rubber.

* * * * *

UNITED STATES PATENT AND TRADEMARK OFFICE

CERTIFICATE OF CORRECTION

PATENT NO. : 4,359,178

DATED : November 16, 1982

INVENTOR(S) : Hayashi et al.

It is certified that error appears in the above—identified patent and that said Letters Patent is hereby corrected as shown below:

Col. 3, line 60, "16b" should read -- 15 --;

Col. 3, line 61, "15" should read -- 16b --; and

Signed and Sealed this

*Twelfth* Day of *July 1983*

[SEAL]

*Attest:*

GERALD J. MOSSINGHOFF

*Attesting Officer*

*Commissioner of Patents and Trademarks*